US005320492A

United States Patent [19]

Bouru et al.

[11] Patent Number: 5,320,492

[45] Date of Patent: Jun. 14, 1994

[54] SEALING AND RETAINING DEVICE FOR A ROTOR NOTCHED WITH PIN SETTINGS RECEIVING BLADE ROOTS

[75] Inventors: Michel A. Bouru, Moissy Cramayel; Jean-Louis Charbonnel, Le Mee Sur Seine; Jean-Claude Prato, Cesson, all of France

[73] Assignee: Societe Nationale d'Etude et de Construction de moteurs d'Aviation "SNECMA", Paris, France

[21] Appl. No.: 87,903

[22] Filed: Jul. 9, 1993

[30] Foreign Application Priority Data

Jul. 22, 1992 [FR] France ..... 92 09025

[51] Int. Cl.[5] ..... F01D 5/32

[52] U.S. Cl. ..... 416/220 R; 416/221

[58] Field of Search ..... 416/221, 220 R, 219 R

[56] References Cited

U.S. PATENT DOCUMENTS

| | | | |
|---|---|---|---|
| 2,998,959 | 9/1961 | Haworth et al. | 416/221 |
| 3,957,393 | 5/1976 | Bandurick | 416/220 R |
| 4,192,663 | 3/1980 | Herzner | 416/221 |
| 4,730,983 | 3/1988 | Naudet et al. | 416/221 |
| 4,767,276 | 8/1988 | Barnes et al. | 416/221 |
| 5,052,893 | 10/1991 | Catte | 416/221 |
| 5,169,289 | 12/1992 | Lalanne | 416/221 |
| 5,211,407 | 5/1993 | Glynn et al. | 416/220 R |
| 5,257,909 | 11/1993 | Glynn et al. | 416/219 R |

FOREIGN PATENT DOCUMENTS

| | | |
|---|---|---|
| 0089272 | 9/1983 | European Pat. Off. . |
| 1307564 | 9/1962 | France . |
| 2603333 | 3/1988 | France . |

*Primary Examiner*—Edward K. Look
*Assistant Examiner*—James A. Larson
*Attorney, Agent, or Firm*—Oblon, Spivak, McClelland, Maier & Neustadt

[57] ABSTRACT

A sealing and retention device for the blades of a rotor which engage with axial pin settings of the rotor wherein the device includes, in a first embodiment, a flange in the shape of a circular collar which engages the rotor and a locking ring which engages the blades and the flange wherein the locking ring has a conical portion which engages a first protuberance portion of the blades such that upon centrifugal sliding of the locking ring in a radially outward direction, the locking ring is axially displaced toward the flange. The device may also include a conical crest located on the rotor and the flange may have a conical surface for engaging the conical crest of the rotor.

8 Claims, 5 Drawing Sheets

SEALING AND RETAINING DEVICE FOR A ROTOR NOTCHED WITH PIN SETTINGS RECEIVING BLADE ROOTS

BACKGROUND OF THE INVENTION

Field of the Invention

The invention relates to a sealing and retention device for a rotor notched with axial pin settings receiving blade roots.

Discussion of the Background

Such a construction is encountered on certain aircraft engine turbines and suffers from the disadvantage that the compressed air has to leak through the pin settings into clearances left behind beneath the roots of the blades, which considerably reduces the turbine efficiency. Therefore sealing devices have already been designed for combatting this phenomenon and the invention can be looked upon as an improvement of French Patent 2,603,333, in which the device comprises two sealing parts, namely an elastic flange split in the form of a planar, circular collar, which is joined to one end face of the rotor and masks the pin settings, and a joint compressed between one face of the flange and a ledge or rim at one end of the blade roots. This joint or locking ring is also in the form of a circular, split, planar collar and the axial compression which it establishes completes the sealing action by preventing the air from leaking through the blade roots while the flange covers the pin settings. Moreover, the compressed locking or retaining ring prevents the blades from sliding in the pin settings and therefore maintains them in an invariable position, because they abut against the rotor by another ledge located at their opposite end.

However, with this design there are grooves in the rotor and the blade roots, the radial edges of the flange and the locking ring touch the bottom, which produces high forces, which can lead to deterioration of the contacting parts, particularly when starting up produces high centrifugal forces.

SUMMARY OF THE INVENTION

A sealing and retention device for the blades of a rotor which engage with axial pin settings of the rotor include, in a first embodiment, a flange in the shape of circular collar which engages the rotor and a locking ring which engages the blades and the flange wherein the locking ring has a conical portion which engages a first protuberance portion of the blade such that, upon centrifugal sliding of the locking ring in a radially outward direction, the locking ring is axially displaced toward the flange. The device may also include a conical crest located on the rotor and the flange may have a conical surface for engaging the conical crest of the rotor.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

Figure 1:
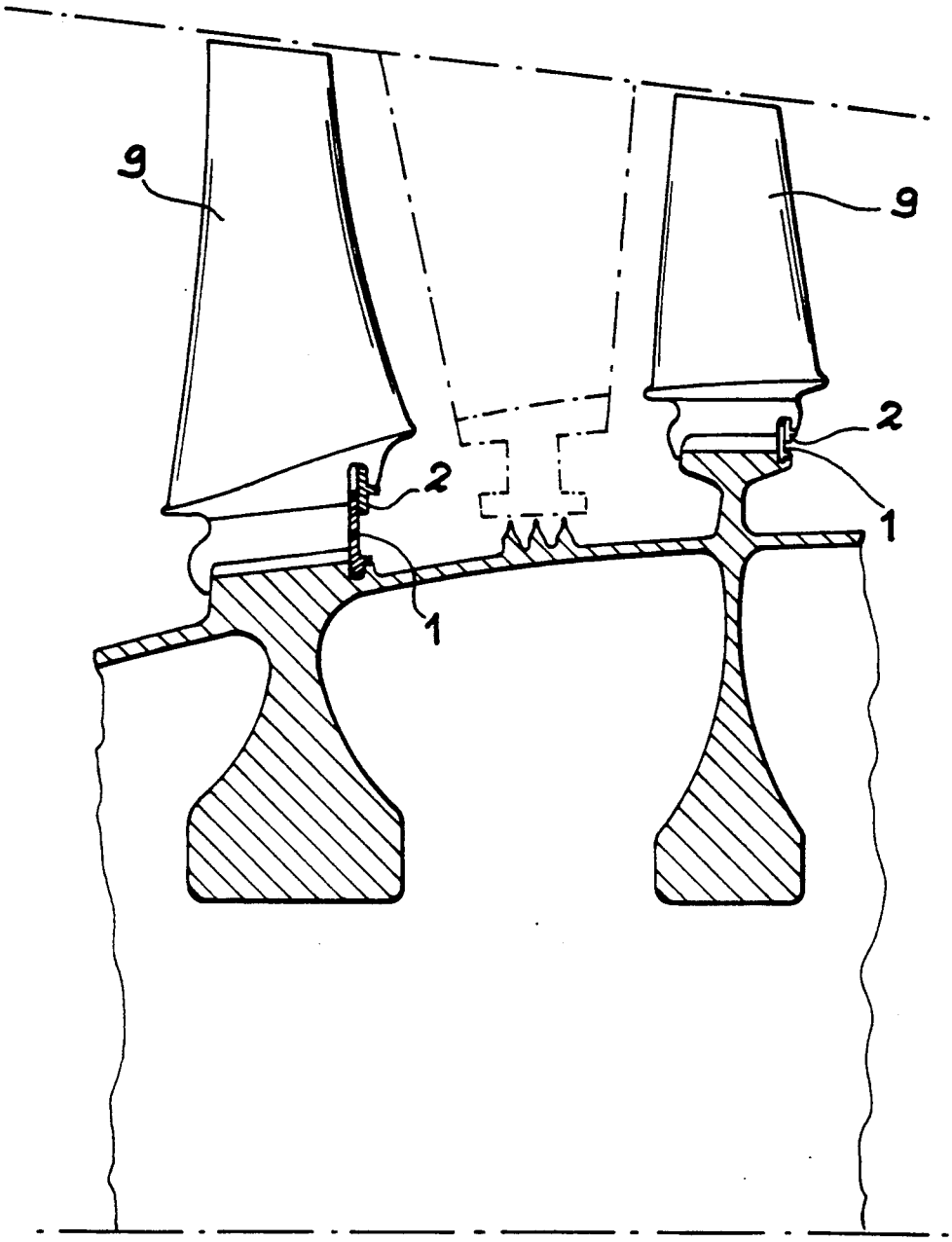
FIG. 1 is a general view of a turbine equipped with the invention.
Figure 2:
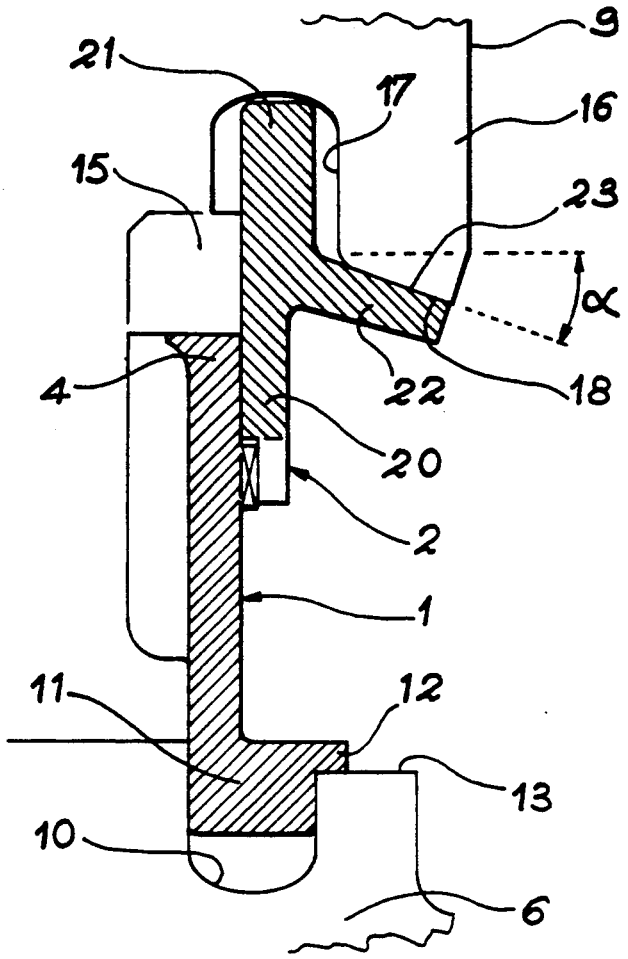
FIG. 2 shows an enlarged scale an area of interest for FIG. 1.
Figure 3:
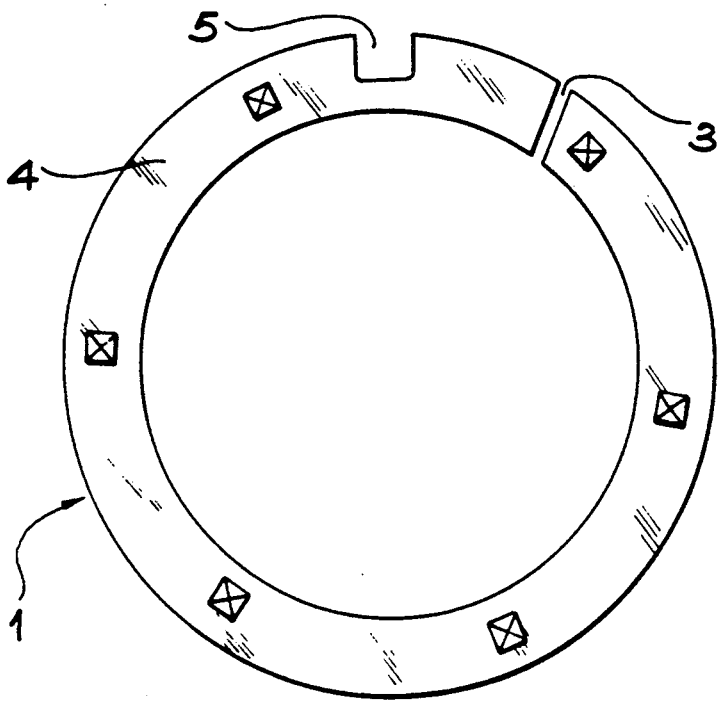
FIG. 3 shows a front view of the flange in front view.
Figure 4:
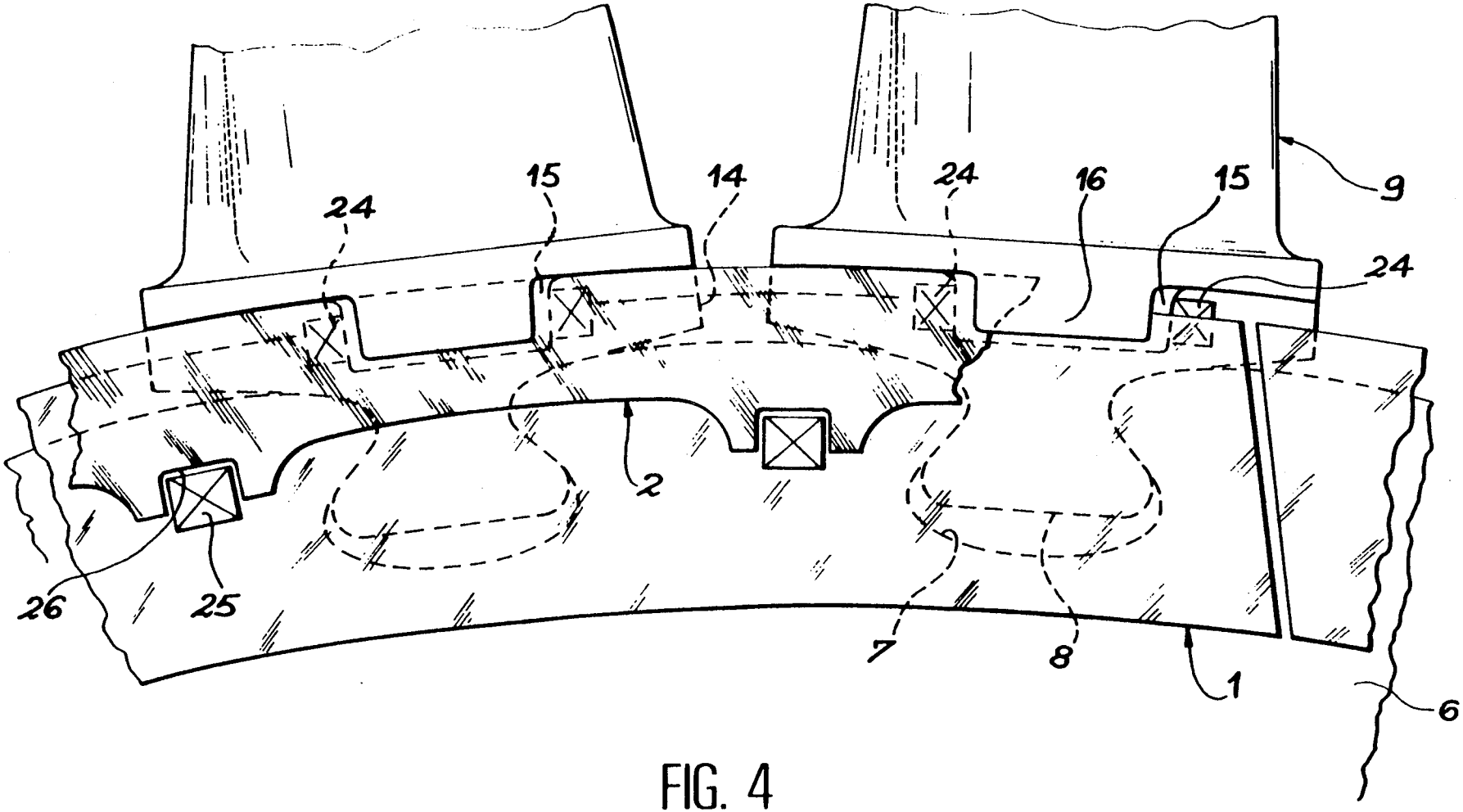
FIG. 4 illustrates a portion of the turbine as seen from a front view, it being possible to see the flange and the locking ring.

In a first embodiment of the invention illustrated in FIGS. 1 to 3, the flange is designated by 1 and the locking ring by 2. The flange 1 is in the form of a planar, circular collar and has a slit 3, which makes it possible to expand and contract it in the radial direction and in a random manner as a result of its elasticity, it e.g. being metallic. On its radially outer edge 4 it has a cutout 5 for freeing the pin settings of the rotor and for easily permitting the insertion of the blade roots by making, in known manner, the flange 1 rotate so as to position the cutout 5 in front of each pin setting 7 of the rotor in successive manner before placing it between two pin settings 7 when assembly is completed.

As is frequently the case, it would be possible to replace a flange 1 in one piece by sectors placed in front of each pin setting.

The axial pin settings 7 of the rotor are substantially dovetial-shaped and in them can slide the roots 8 of blades 9. It also has an internal groove 10 surrounded at a limited distance by the pin settings 7 and which receives a widened internal edge portion 11 of the flange 1. The internal edge 11 occupies the entire width of the internal groove 10, but sometimes does not extend up to its bottom. An axial ledge 12 can be added in order to obtain a firm wedging in the radial direction of the flange 1. The ledge 12 bears on a circular surface 13, oriented towards the outside and adjacent to the internal groove 10 of the rotor disk 6.

The external edge 4 of the flange 1 bears against axial protuberances 15 of the blades 9, which compresses the flange 1 towards the inside in the radial direction. Moreover, the blades 9 have on a portion of their width a ledge 16 oriented radially towards the inside and which represents an angular sector of an external groove 17. Each of the ledges 16 has a conical face 18 of inclination angle $\alpha$, oriented radially towards the inside and axially towards the flange 1. The conical face 18 is at the end of a protuberance formed by the ledge 16.

The locking ring 2 is constituted by a radially inner portion 20 pressed against the facing face of the flange 1 close to the protuberances 15, a radially outer portion 21 located in the outer groove 17, but without touching its walls and in particular its bottom, and a conical portion 22 supported on the conical face 18 by a corresponding conical face 23 of the same inclination and which is advantageously coated with a wear-resisting material. Therefore the locking ring 2 is forced axially against the flange 1 and establishes with the latter a good sealing action when forces tend to expand the locking ring 2 and make the conical faces 18 and 23 slide on one another, such as the centrifugal forces produces when the rotor rotates. Sealing is completed by the positioning in the internal groove 10 of the internal edge 11. Therefore leaks are prevented or at least greatly reduced both by the interior of the flange 1 and its junction with the locking ring 2. Dog teeth 24 are provided on the locking ring 2 on either side of the protuberances 15 in order to lock the locking ring from rotation and an identical manner dog teeth 25 are provided on the outer surface of the flange 1 and are placed in cutouts 26 on the internal edge of the locking ring 2 in order to perfect the connection of said two parts.

Figure 5:
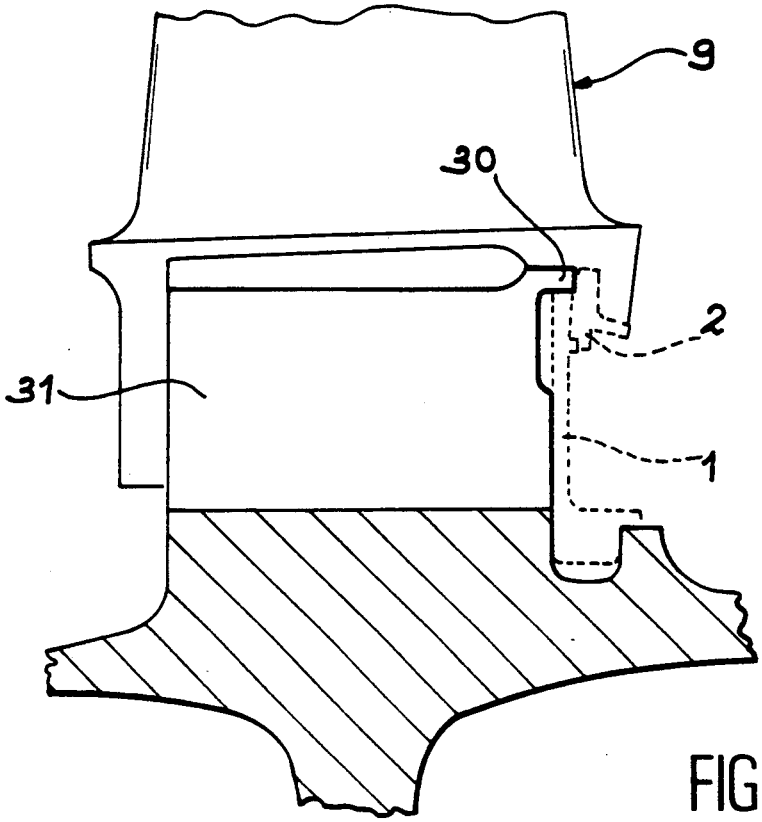
FIGS. 5 and 6 show views identical to FIGS. 2 and 4 but show a second embodiment of the invention.
Figure 6:
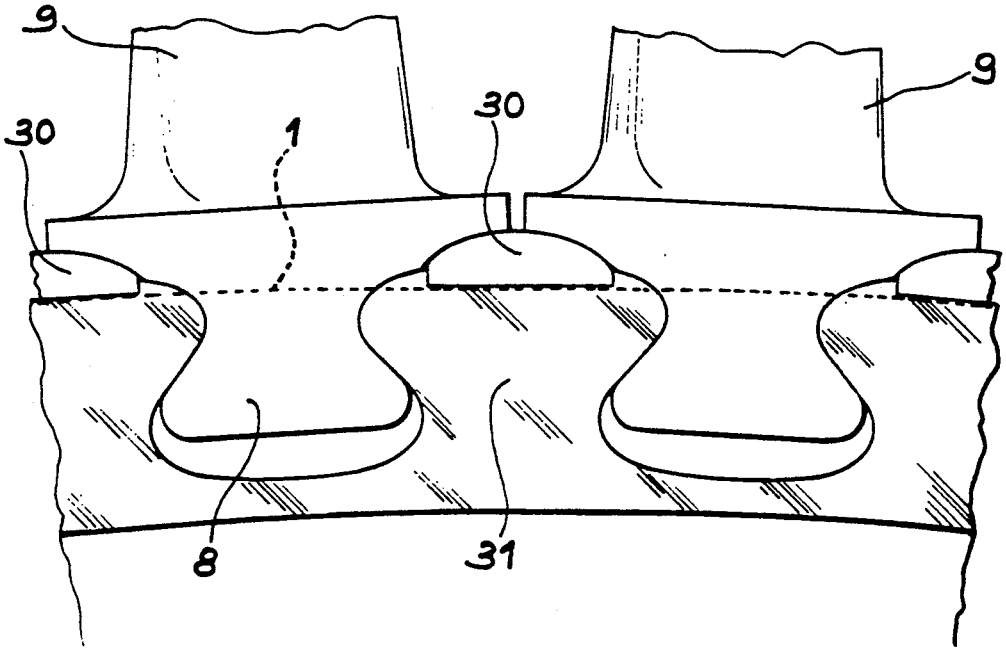

Another construction shown in FIGS. 5 and 6 is identical, but in place of the protuberances 15 belonging to the blades 9 uses other protuberances 30 located on the outer edge of the portions 31 of the rotor disk 6, which separate consecutive pin settings 7.

Figure 7:
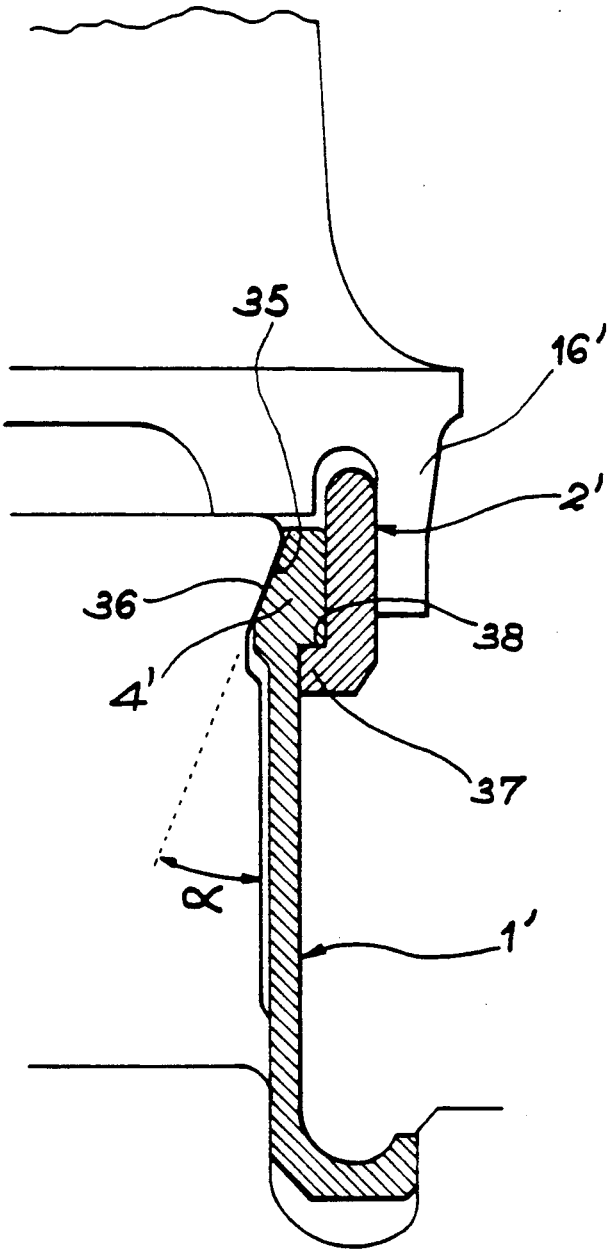
FIG. 7 shows a view identical to FIG. 2 but for a third embodiment of the invention.

In the third embodiment of FIG. 7, the situation is significantly different, because the conical protuberances used for ensuring the axial compression of the flange 1' and the locking ring 2' are constituted by a conical crest 35 formed from portions located on the axial stopping face of the rotor disk 6 between the pin settings 7. The outer edge 4' of the flange 1' consequently carries a conical surface 36 having the same orientation as the conical crest 35, i.e. towards the locking ring 2' in the centrifugal direction and which slides thereon. The conical surface 36 can be covered with a wear-preventing material.

In this case the locking ring 2' bears against a transverse face of the ledges 16' and is almost perfectly flat, with the exception of an internal crest 37, which projects in the direction of the flange 1' and is inserted in a circular protuberance 38 on the outer edge 4'. Thus, the technical effects encountered in the preceding embodiments again occur. The conical surfaces slide as a result of the expansion forces and this leads to an axial compression force, which maintains the seal and ensures that the blades are kept in place. Protuberances oppose the centrifugal movement of the other of the parts of the pair constituted by the flange and the locking ring and consequently there is no contact with the bottom of the outer groove. The bottom of the inner groove also remains free.

Other embodiments of the invention can be envisaged in the light of these considerations and the embodiments already described.

We claim:

1. A sealing and retention device for blades of a rotor which engage with axial pin setting of the rotor, which comprises:

a flange in the shape of a circular collar which engages said rotor;

a locking ring which engages said blades and said flange wherein said blades have a first protuberance extending therefrom and said locking ring has a conical portion which engages said first protuberance of said blades such that upon centrifugal sliding of said locking ring in a radially outward direction due to a centrifugal force applied thereto upon rotation of the rotor, said locking ring is axially displaced toward said flange.

2. A sealing and retention device as claimed in claim 1, wherein said blades have at least one second protuberance for engaging said flange.

3. A sealing and retention device as claimed in claim 2, wherein said at least one second protuberances comprises a plurality of protuberances positioned so as to surround said flange.

4. A sealing and retention device as claimed in claim 1, wherein said rotor has a groove formed therein and said flange has a radially inner edge which is positioned in said groove.

5. A sealing and retention device as claimed in claim 1, wherein said rotor includes a rotor disc which has a plurality of protuberances located at an outer edge portion thereof for engaging said flange wherein said rotor disc protuberances are respectively located between neighboring pin settings of said axial pin settings.

6. A sealing and retention device for blades of a rotor which engage with axial pin settings of the rotor, which comprises:

a conical crest located on said rotor;

a flange in the shape of a circular collar which has a conical face for engaging said conical crest of said rotor;

a locking ring which engages said blades and said flange wherein said ring has an internal crest which engages a radial protuberance such that upon centrifugal sliding of said flange in a radially outward direction due to a centrifugal force applied thereto upon rotation of the rotor, said flange is axially displaced toward said locking ring.

7. A sealing and retention device as claimed in claim 6, wherein the blades have a radially inwardly extending ledge member against said which locking ring engages.

8. A sealing and retention device as claimed in claim 6, wherein said internal crest projects toward said flange and is inserted in said protuberance.

* * * * *